US005280659A

United States Patent [19]

Park

[11] Patent Number: 5,280,659

[45] Date of Patent: Jan. 25, 1994

[54] MULTIPURPOSE TOOL

[75] Inventor: No K. Park, Chungcheongnam-do, Rep. of Korea

[73] Assignee: Jin Yong Kim, Pusanjin-Ku, Rep. of Korea

[21] Appl. No.: 959,156

[22] Filed: Oct. 9, 1992

[30] Foreign Application Priority Data

Sep. 18, 1992 [KR] Rep. of Korea ..... 17059

[51] Int. Cl.[5] ..... B25F 1/04

[52] U.S. Cl. ..... 7/128; 7/107; 7/132; 7/139; 7/144

[58] Field of Search ..... 7/107, 125, 127, 128, 7/129, 130, 131, 132, 133, 134, 142, 137, 138, 143, 139, 144, 158, 167, 170, 901

[56] References Cited

U.S. PATENT DOCUMENTS

| | | | |
|---|---|---|---|
| 95,793 | 10/1869 | Granier | 7/137 |
| 245,398 | 8/1881 | Phillips | 7/130 |
| 276,793 | 5/1883 | Erdman et al. | 7/128 |
| 990,543 | 4/1911 | Gilchrist | 7/128 |
| 2,668,464 | 2/1954 | Paules | 7/130 |
| 3,710,406 | 1/1973 | Stanford | 7/130 |
| 4,028,756 | 6/1977 | Couto | 7/130 |
| 4,953,248 | 9/1990 | Trombetta | 7/127 |
| 4,995,128 | 2/1991 | Montgomery et al. | 7/127 |
| 5,014,379 | 5/1991 | Hull et al. | 7/127 |
| 5,033,140 | 7/1991 | Chen et al. | 7/127 |

*Primary Examiner*—Roscoe V. Parker
*Attorney, Agent, or Firm*—Bradford E. Kile; Ruffin B. Cordell

[57] ABSTRACT

A multipurpose tool comprising a pair of movable members members which are hinged together and includes four working stations each of which has a pair of working edges. The pairs of working edges have different working functions. The multipurpose tool of the present disclosure is composed of a material of good wear-resistance, toughness and hardness and has a disadvantage in that all of the manual works, for example, stripping of an electric wire, cutting of wires, preventing the rotation of pipes, pounding, scissoring of a thin metal plate, loosening or tightening of screws or nuts, can be done only by the multipurpose tool of the present disclosure.

6 Claims, 5 Drawing Sheets

MULTIPURPOSE TOOL

BACKGROUND OF THE INVENTION

The present invention relates to a manual tool, and more particularly to a multipurpose manual tool which used in many kinds of works so as to improve the operation efficiency.

Manual tools are generally used in pounding, stripping a covering, fixing, cutting or turning a work material and the like.

A hammer is used as a pounding tool. A nipper and scissors are used as stripping and cutting tools. A vice is used as a fixing tool. Plier, wrench and screwdriver are used as turning tools.

These tools are selectively used according to the kinds of works, and have been manufactured individually.

Thus, in case of using a certain tool, if all of the above tools are not prepared, the work can not be performed or can not help being delayed.

Furthermore, it is difficult to carry all of them in one keeping box due to the weight of the tools and also it is easy to lose them during keeping or using.

In addition, it is not easy to prepare all of these tools owing to the economic burden.

SUMMARY OF THE INVENTION

An object of the present invention is to provide a multipurpose tool which performs various kinds of works conveniently and quickly, and which is easy to keep and carry.

Another object of the present invention is to provide a multipurpose tool which is inexpensive and thus can be used as a house hold tool.

According to the present invention, the multipurpose tool comprises a pair of movable members having handle sections at one end thereof and working edges which are crisscross with each other and being hinged together by a pin, and four working stations having the working edges, the working edges being folded or unfolded about the pivot pin.

DETAILED DESCRIPTION OF THE INVENTION

Figure 1:
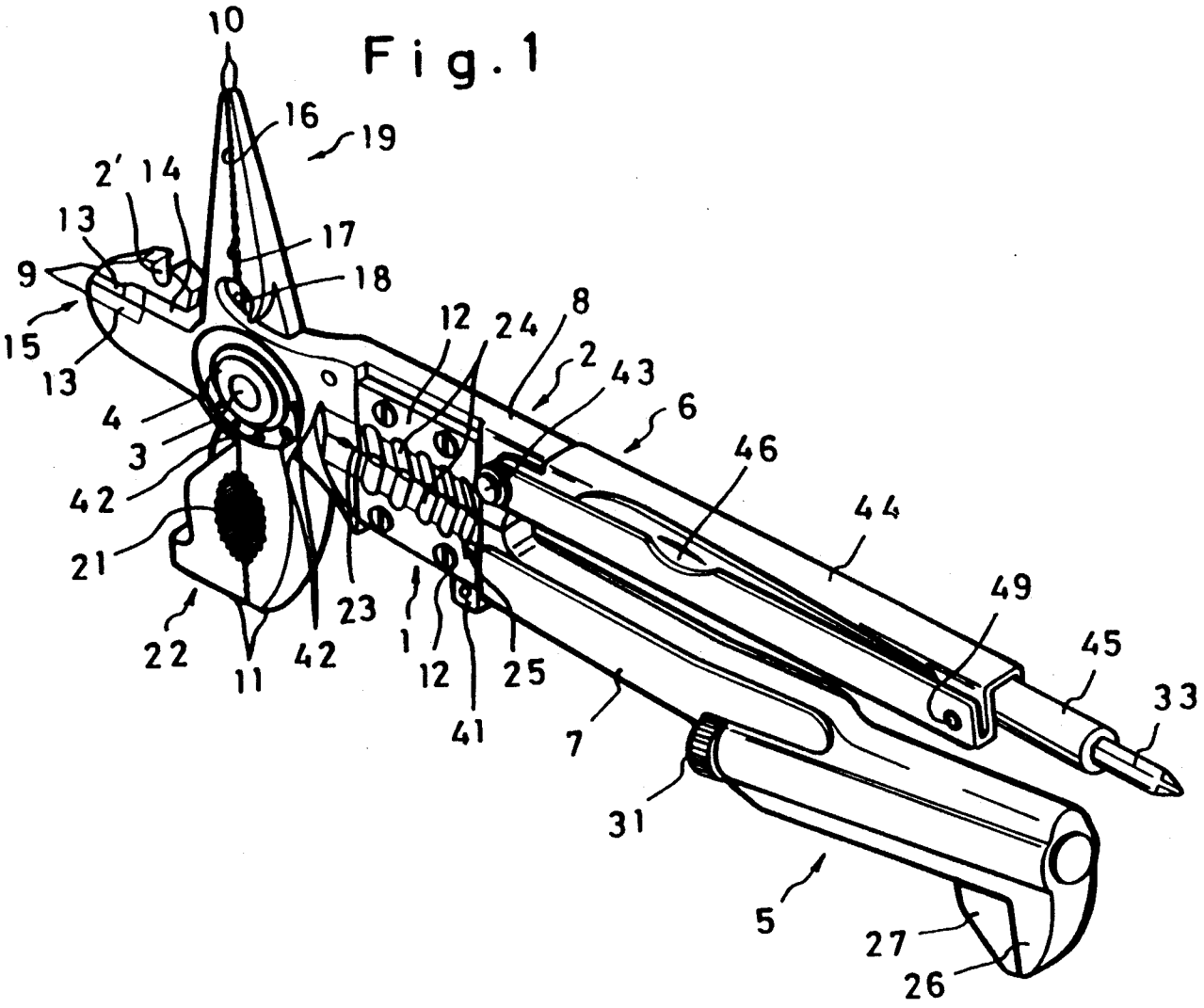
FIG. 1 is a perspective view of a multipuropose tool of the present invention.
Figure 2:
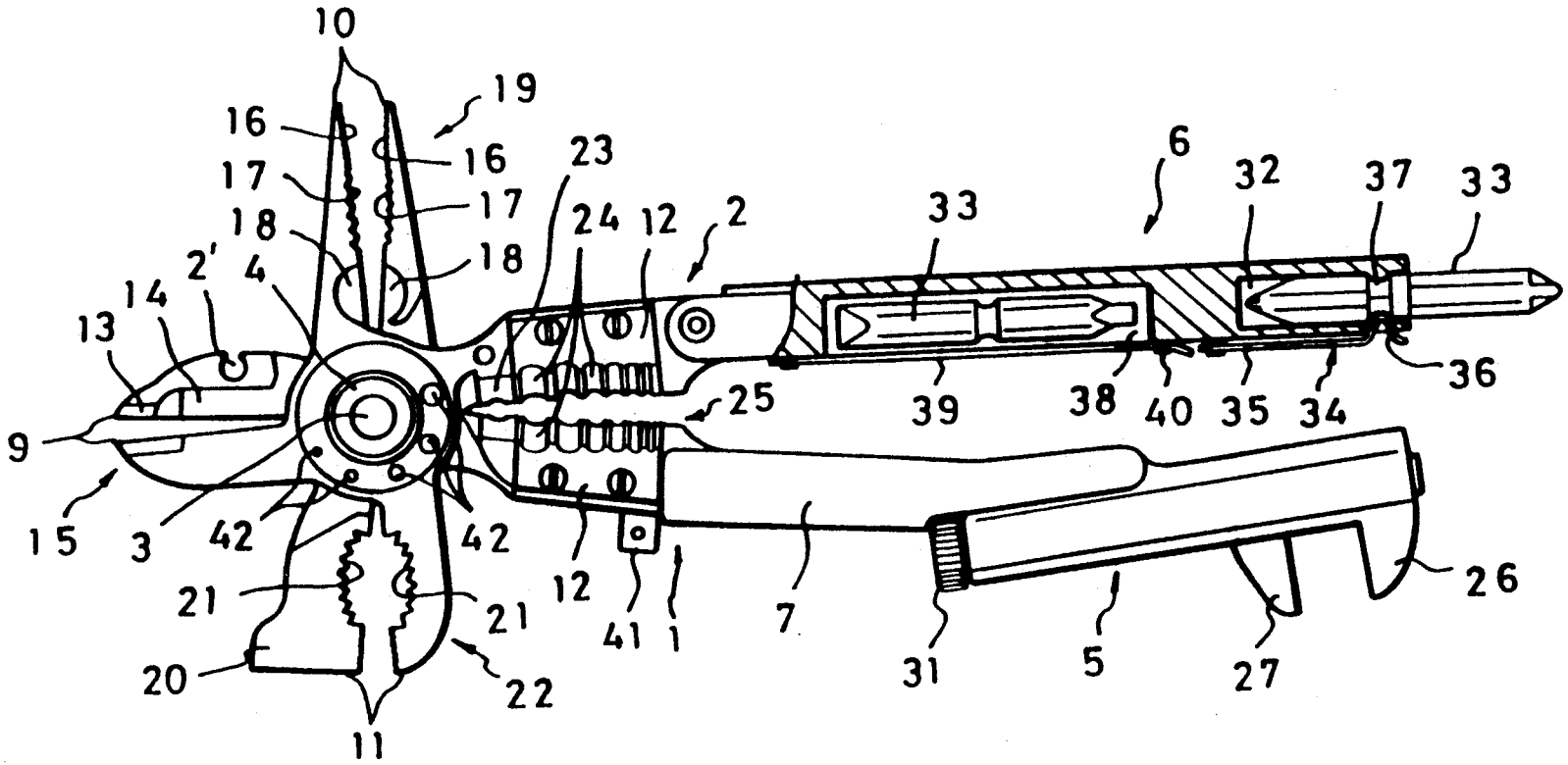
FIG. 2 is a front view of a multipurpose tool of the present invention.

In FIGS. 1 and 2, a pair of movable members 1, 2 are hinged together by a hinge 3 to move like scissors. A conventional pin 4 is used as the hinge 3. For preventing falling of the movable member 1 from the pin 4, the pin 4 is enlarged at opposite ends thereof to serve as a rivet. A nut (not shown) may be used to engage the opposite ends of the pin 4. When it is desired to individually use an adjustable wrench member 5 and a screwdriver member 6, the nut may be released to separate the movable members 1, 2 from each other.

The movable members 1, 2, respectively have handle sections 7,8 and pairs of facing working edges 9, 10, 11, 12 which comprise a substantially cross shape and move in cooperation like scissors to perform various works.

The first pair of working edges 9 are provided opposite the handle sections 7, 8 and constitute a first working section 15 which comprises a pair of nipping edges 13 for cutting an electric wire and scissoring edges 14 for cutting a thin metal plate.

The second pair of working edges constitute a second working section 19 which comprises a pair of jaw plates 16 for insertion of snap rings or bearings, or picking up wires or light metals, a pair of small serrations 17 for holding a pipe of small diameter and a pair of cutting edges 18 for cutting wires and the like.

The third pair of working edges 11 constitute a third working section 22 which comprises a hammer section 20 for pounding and a pair of large serrations 21.

The fourth pair of working edges 12 constitute a fourth working section 25 which comprises a pair of pressing sections 23 and pairs of stripping sections 24 for stripping the covering from electric wires 24. Each pair of stripping sections 24 varies in the diameter of the edges thereof depending on the thickness of electric wires to be stripped.

The members constituting the working sections 15, 19, 22 and 25 may be replaced by another ones of which function is identical with the members, and may be interchanged with one another in the position thereof.

Figure 3:
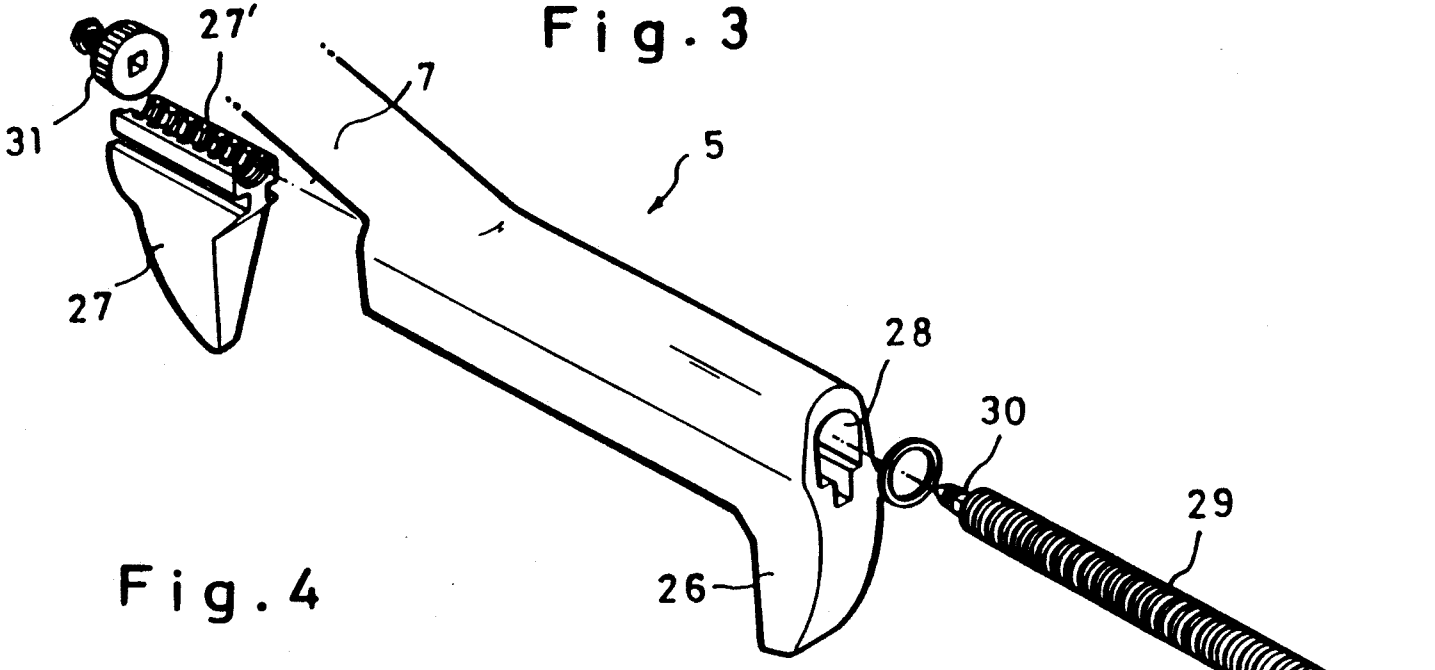
FIG. 3 is a perspective view of an adjustable wrench section of the present invention.
Figure 4:
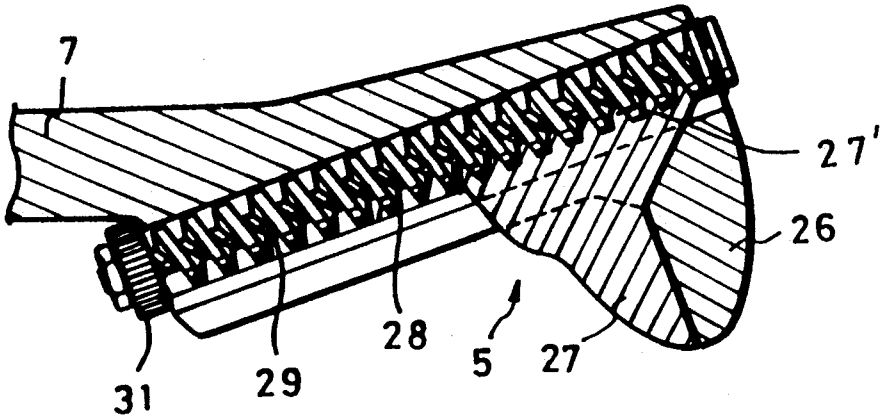
FIG. 4 is a side sectional view of FIG. 3.

The adjustable wrench member 5 consists of a fixed jaw 26 and a movable jaw 27. FIGS. 3 and 4 show a detailed construction of the adjustable wrench member 5.

The fixed jaw 26 constitutes the rear end of the handle section 7 and has a lengthwise channel 28 through which a lead screw 29 is rotatably mounted. The lead screw 29 has a non-circular end 30 which is received in a distance adjusting knob 31 for simultaneous rotation with the distance adjusting knob 31.

The movable jaw 27 has threads 27' engaging the lead screw 29 and is moved forward and rearward upon the rotation of the lead screw 29. With this arrangement, the movable jaw 27 is adjusted to various size of heads of bolts or the like.

Figure 5:
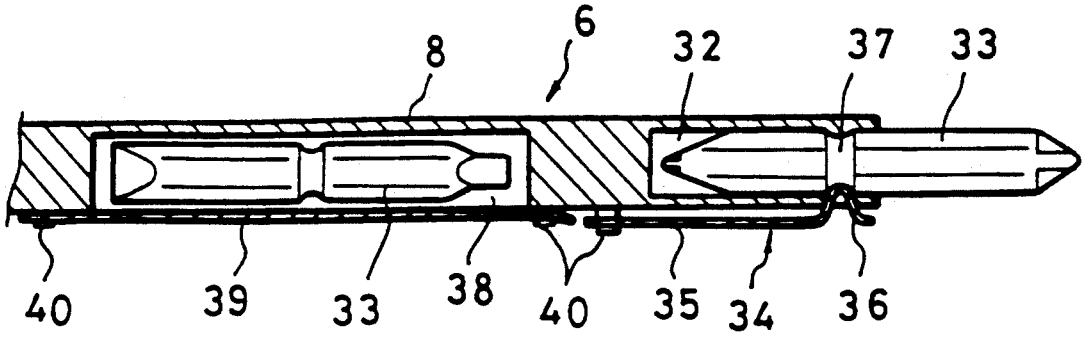
FIG. 5 is a side sectional view of a screwdriver section of the present invention.

FIG. 5 shows a detachable screwdriver 33 assembled to the movable member 2. A lengthwise groove 32 is provided in the movable member 2 for receiving the detachable screwdriver 33. A retaining member 34 is provided for preventing inadvertent slipping of the screwdriver 33 from the groove 32.

The retaining member 34 includes a resilient plate 35. The resilient plate 35 has one end secured to the handle member 8. The other curved end 37 of the resilient plate 35 is inserted into the groove 32 for preventing slipping of the screwdriver 33 from the groove 32.

The screwdriver 33 has a recession 37 for engaging the curved end 36 of the resilient plate 35.

As an alternative to the above retaining member 34, a permanent magnet may be provided inside the groove 32 for engaging the metal driver 33. Furthermore, the retaining member 34 may have any construction if it can hold the screwdriver 33.

As the screwdriver 33, either a general screwdriver or philips screwdriver may be kept in a keeping recess 38 in the handle member 8. A cover 39 is provided for opening or closing the keeping recess 38.

The cover 39 is secured to the handle member 8 at its one end and has a hole at the other end thereof for receiving a protrusion 40 extending from the handle member 8.

Figure 8:
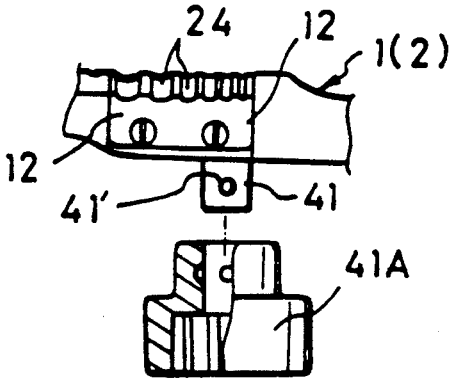
FIG. 8 is an enlarged view showing rectangular protrusion ready for engaging socket wrench.
Figure 9:
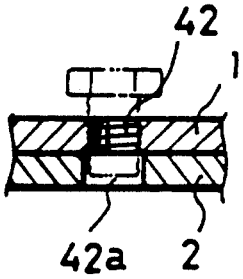
FIG. 9 is an enlarged sectional view showing bolt cutting holes formed in movable members.

As shown in FIG. 8, a rectangular protrusion 41 is formed on one of the handle members 7, 8 for engaging a socket wrench 41A. A spring-loaded ball 41' is mounted on the inside of the rectangular protrusion 41 for controlling engagement or disengagement of the socket wrench 41A.

The portion around the hinge 3 is comparatively large for forming several bolt cutting holes 42, 42*a* therein. The bolt cutting holes 42, 42*a* are spaced a predetermined distance from the hinge 3 and different in size to fit various size of bolts. The bolt cutting holes 42, 42*a* are provided for cutting small screws by the desired length. The bolt cutting hole 42 having a female screw therethrough is in axial alignment with the bolt cutting hole 42*a* which has a slightly larger diameter than the hole 42. When a small screw is desired to be cut, the movable members 1, 2 are widened and the small screw is inserted through the holes 42, 42*a* and tightened by the movable members 1, 2, whereby the small screw may be cut without damage.

Figure 6:
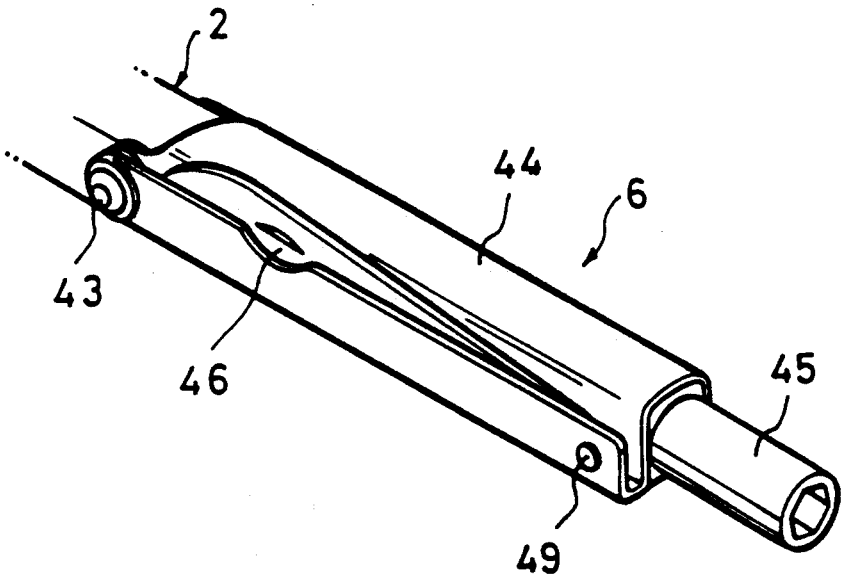
FIG. 6 is another embodiment of the screwdriver section of the present invention.

FIG. 6 is a perspective view of another embodiment of the screwdriver member 6. The screwdriver member 6 includes a cover 44 pivoted to the movable member 2 by a pivot pin 43, a socket 45 fixed inside of the cover 44 and a foldable knife 46 folded in the side channel of the cover 44.

Figure 7A:
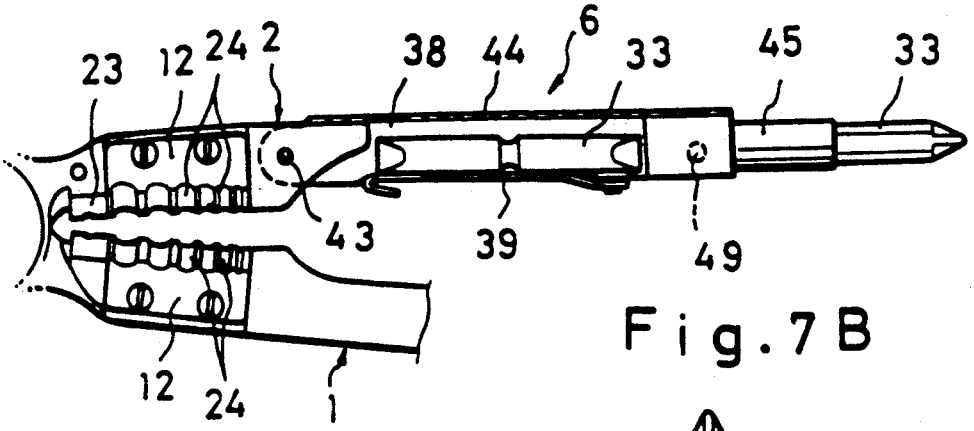
FIG. 7A is a side sectional view of the screwdriver section in unfolded position.
Figure 7B:
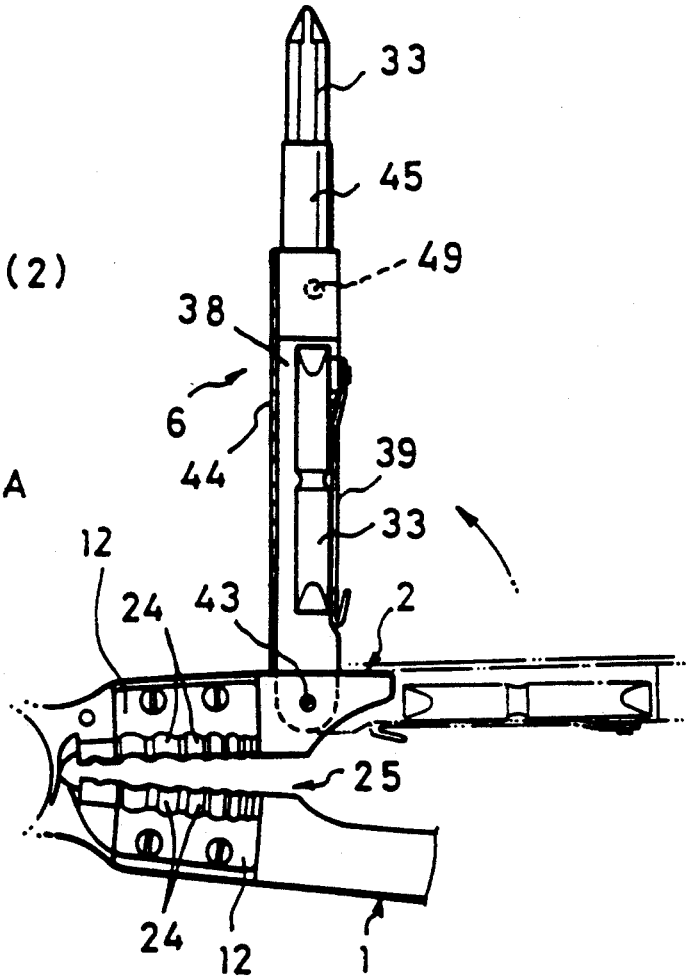
FIG. 7B is a side sectional view of the screwdriver of FIG. 6 in folded position.

FIG. 7 is a side sectional view of the screwdriver member 6. The storing recess 38 is covered by the cover 44 and keeps screwdrivers or wrenches for engaging the socket 45. As shown in FIG. 7B, the screwdriver 6 moves through ninety degrees with respect to either of the movable members 1, 2.

With this arrangement, the working sections 15, 19, 22, 25 and the jaw 16 are fully compacted when the movable members 1, 2 are fully closed.

With the compact condition, the hammer section 20 may be used as a pounding tool and the driver 33 of the driver member 6 may be used for loosening or tightening screws.

When loosening or tightening screws, a user may hold and turn the opposing second and third working sections 19 to apply stronger force to the screws.

When it is desired to strip an electric wire, the movable members 1,2 are unfolded to unfold the fourth pair of working edges 12. Thereafter, the wire is positioned between the stripping sections and the movable members 1, 2 and then the movable members 1, 2 are folded, thus folding the stripping section 24, whereby the stripping sections 24 will be overlapped causing the covering of the wire to be cut. The stripping section 24 may be formed in one piece with the movable members 1, 2 or it may be separately secured thereto by means of a screw 24' in view of the life of the stripping section 24.

The nipping edges 13 are provided in the first working section 15 for cutting wires. The scissoring edges 14 cut a thin metal plate. A nail guide recess 2' is provided in the first working section 15 for preventing bending of a nail when driving the nail.

The small serration 17 is provided in the second working section 19 for holding a pipe of a comparatively small diameter, thus preventing the rotation of the pipe. The cutting edges 18 are provided for cutting wires.

The third working section 22 is used as a pounding tool by use of the hammer section 20 and as a holding tool by use of the comparatively large serration 21 which hold a comparatively thick pipe.

The above-described works are performed by folding and unfolding the movable members 1, 2. All of the works can be done only by use of the multipurpose tool of the present invention since the movable members 1, 2 are provided with almost all kinds of tool members.

The multipurpose tool of the present invention is less likely to be lost and easy to transport and store since all of the tool members are provided on one body.

The adjustable wrench member 5 is provided with the movable member 1. With rotation of the distance adjusting knob 31, the lead screw 29 will rotate causing the female screw of the movable jaw 27 to be guided to move right and left according to the rotating direction of the lead screw, thus loosening or tightening a nut. It is within the scope of the present invention that the adjustable wrench section 5 is provided on the handle sections 7, 8 in which any of the working sections 15, 19, 23, 25 are provided.

When the screwdriver 33 is to be replaced by another one, the screwdriver 33 is pulled outwardly causing the curved end 36 to change elastically forcing the driver to be removed from the groove 32. Thereafter, another driver having been kept in the keeping recess 38 is removed from the recess 38 and pushed into the groove 32. Then, the screwdriver removed from the groove 32 is kept in the keeping recess 38.

Since the screwdriver shown in FIG. 6 is provided with a socket 45, a cover 44 in FIGS. 7A, 7B is used in either a folded or unfolded condition.

The multipurpose tool of the present invention is composed of a material of good wear-resistance, toughness and hardness and has a disadvantage in that all of the manual works, for example, stripping of an electric wire, cutting of wires, preventing the rotation of pipes, pounding, scissoring of a thin metal plate, loosening or tightening of screws or nuts, can be done only by the multipurpose tool of the present invention.

Since, with the present invention tool, at least more than one work can be done at one working section, any work can be done regardless of changing the tool members at the working sections.

What is claimed is:

1. A multipurpose tool comprising:

a pair of movable pivoted to each other by a pin and having handle sections extending to one side:

a first working station having opposing jaws for cutting work material, the first working station being opened and closed by movement of said handle sections and being disposed on an opposite side of said pin with respect to said handle sections, said first working station having opposing nipping edges at a distal end of said first working station with respect to said pin and being operable for cutting an electric wire, and opposing scissor edges at a proximal end of said first working station with respect to said pin and being operable for cutting metal sheet material;

a second working station having opposing jaws disposed substantially perpendicular to said first working station and formed integrally with said movable members, the second working station being opened and closed about said pivot pin in unison with the jaws of said first working station and said jaws having first inner opposing, serrated surfaces for holding work material and opposing cutting edges positioned upon said jaws between said serrated surfaces and said pin and being operable for cutting wire;

a third working station having opposing jaws formed integrally with the movable members, and being opened and closed about said pivot pin, in unison with the jaws of the first and second working stations and said jaws being disposed opposite to the second working station, the third working station having second inner opposing, serrated surfaces fashioned upon opposing arcuate segments of said opposing jaws, said serrated surfaces have a larger spacing than the serrated surfaces of said first inner opposing serrated surfaces, at least one of said opposing jaws having an enhanced hammer section at a distal end thereof; and a fourth working station having opposing surfaces disposed opposite to the first working station the fourth working station being opened and closed about said pivot pin in unison with the first, second and third working station, the fourth working station including a wire stripping section holding edges of different sizes for stripping covering from electric wires and said fourth working station further having opposing pressing surfaces positioned between said wire stripping section and said pin and being operable for connecting a terminal and an electric wire.

2. A multipurpose tool according to claim 1, wherein at least one of the handle sections of the movable members include a keeping recess for keeping general or Philips screwdrivers and a retainer member for preventing an inadvertent removal of the screwdrivers from the keeping recess.

3. A multipurpose tool according to claim 1, wherein a guide recess is provided in at least one of the first, second or third working station for straightening of a curved nail or proper nailing of a nail.

4. A multipurpose tool according to claim 1, wherein a rectangular protrusion extends form either of the movable members and a spring-loaded ball is mounted in the rectangular protrusion for engaging a socket wrench.

5. A multipurpose tool according to claim 1, wherein a bolt cutting threaded hole is provided in one of the movable members and a hole is provided in the other movable member, the hole being slightly large than the bolt cutting threaded hole, the holes being in axial alignment with each other when the movable members are in unfolded position and being disposed around and spaced a predetermined distance from the pivot pin.

6. A multipurpose tool according to claim 2, wherein the retainer member has a permanent magnet disposed inside of the recess thereof for engaging a metal screw driver.

* * * * *